US006215079B1

(12) United States Patent
Hagleitner

(10) Patent No.: US 6,215,079 B1
(45) Date of Patent: Apr. 10, 2001

(54) PRESSURE CONTROLLED TIME SWITCH

(75) Inventor: Hans Georg Hagleitner, Zell am See (AT)

(73) Assignee: Hagleitner Betriebshygiene Ges.m.b.H. & Co. KG (AT)

( * ) Notice: Subject to any disclaimer, the term of this patent is extended or adjusted under 35 U.S.C. 154(b) by 0 days.

(21) Appl. No.: 09/473,351

(22) Filed: Dec. 28, 1999

(30) Foreign Application Priority Data

Dec. 28, 1998 (AT) ..... 2172/98

(51) Int. Cl.[7] ..... H01H 7/03
(52) U.S. Cl. ..... 200/33 R; 200/34
(58) Field of Search ..... 200/33, 34, 332, 200/335

(56) References Cited

U.S. PATENT DOCUMENTS

| | | | | |
|---|---|---|---|---|
| 2,369,851 | | 2/1945 | Price | 271/2.3 |
| 2,592,786 | | 4/1952 | Birr . | |
| 2,939,664 | | 3/1960 | Liebisch . | |
| 3,081,847 | * | 3/1963 | Smitley | 188/94 |
| 3,495,342 | * | 2/1970 | Goldstein | 34/44 |
| 4,552,999 | * | 11/1985 | Annas | 200/34 |
| 5,306,957 | * | 4/1994 | Ellingham et al. | 307/141 |
| 5,410,930 | | 5/1995 | DeLuca et al. | 83/335 |

FOREIGN PATENT DOCUMENTS

| | | | |
|---|---|---|---|
| 28 41 144 A1 | 4/1980 | (DE) . | |
| 2 060 650 | 10/1979 | (GB) | B65H/17/22 |
| 2043592 | 10/1980 | (GB) . | |
| 2096099 | 10/1982 | (GB) . | |
| 2146094 | 4/1985 | (GB) . | |

* cited by examiner

*Primary Examiner*—Michael L. Gellner
*Assistant Examiner*—Nhung Nguyen
(74) *Attorney, Agent, or Firm*—Lorusso & Loud

(57) ABSTRACT

A time switch has a resetting, movable switching member on which there is provided a suction cup which can be pressed against a counterpart body. The cross-section of an air inlet opening (9) into the reduced-pressure space between the counterpart body and the suction cup when pressed against the counterpart body determines the switching time and is preferably adjustable. A venting opening with which a removable closure element is associated additionally opens into the reduced-pressure space.

4 Claims, 1 Drawing Sheet

PRESSURE CONTROLLED TIME SWITCH

BACKGROUND OF THE INVENTION

1. Field of the Invention

The present invention involves a time switch used for example for triggering off or terminating a procedure when relatively short switching times are preset, only mechanical energy sources are available, and so forth. A non-exclusive area of use lies in motion control for the transportation rollers of paper towel dispensers or the like.

2. Description of the Related Art

Examples in this respect are shown for example in U.S. Pat. No. 2 369 851, U.S. Pat. No. 2, 592,786. U.S. Pat. No. 2,930,664 or GB-A 2 043 592 and GB-A 2 096 099.

BRIEF SUMMARY OF THE INVENTION

The invention concerns a time switch having a switching member on which a suction cup is arranged, a counterpart body against which the suction cup can be pressed forming a reduced-pressure space, with air contained in the suction cup being displaced, an air inlet opening into the reduced-pressure space, the cross-section of the opening preferably being adjustable to establish the release time of the suction cup from the counterpart body, and a resetting device whose resetting force is less than the suction force of the suction cup when pressed against the counterpart body. A needle valve or the like which is provided with an adjusting screw is arranged in the continuously open air inlet opening for fixing the switching time, that is to say that time until the reduced pressure has returned to normal due to the intake of air, to such an extent that the return force of the time switch exceeds the suction force.

The intake of air can be altered by means of the adjusting screw, but that is not an appropriate course of action whenever the switching cycle is to experience a one-off acceleration effect and is then to continue to move at the intended setting.

In accordance with the invention associated with the reduced-pressure space is a venting opening with a sealing closure element which is urged in the closed position, so that it is possible to implement any reduction in the duration of the switching time by lifting off the closure element.

The reduced-pressure space thus has two openings, namely the air inlet opening which determines the predetermined switching time and the venting opening which permits the switching time to be reduced and the closure element of which is for example actuated by hand.

A preferred embodiment provides that the counterpart body is a fixed plate and the venting opening provided with the closure element is disposed in the counterpart body. A plate which is fixed with respect to the housing and which is not flexible improves the sealing contact of the closure element which is arranged in particular on a lever which is engaged on the one hand by a return spring and on the other hand by an actuating element which operates against the return spring.

BRIEF DESCRIPTION OF THE SEVERAL VIEWS OF THE DRAWING

The invention will now be described in greater detail with reference to the Figures of the accompanying drawings without being limited thereto.

In the drawings.

DETAILED DESCRIPTION OF THE INVENTION

Figure 1:
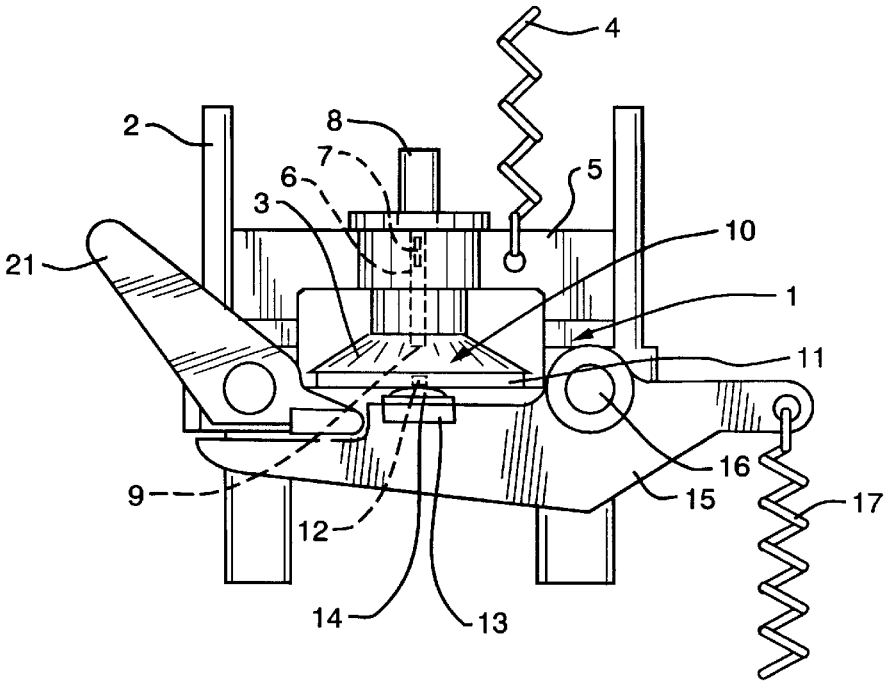
FIG. 1 is a diagrammatic side view of a closed time switch.
Figure 2:
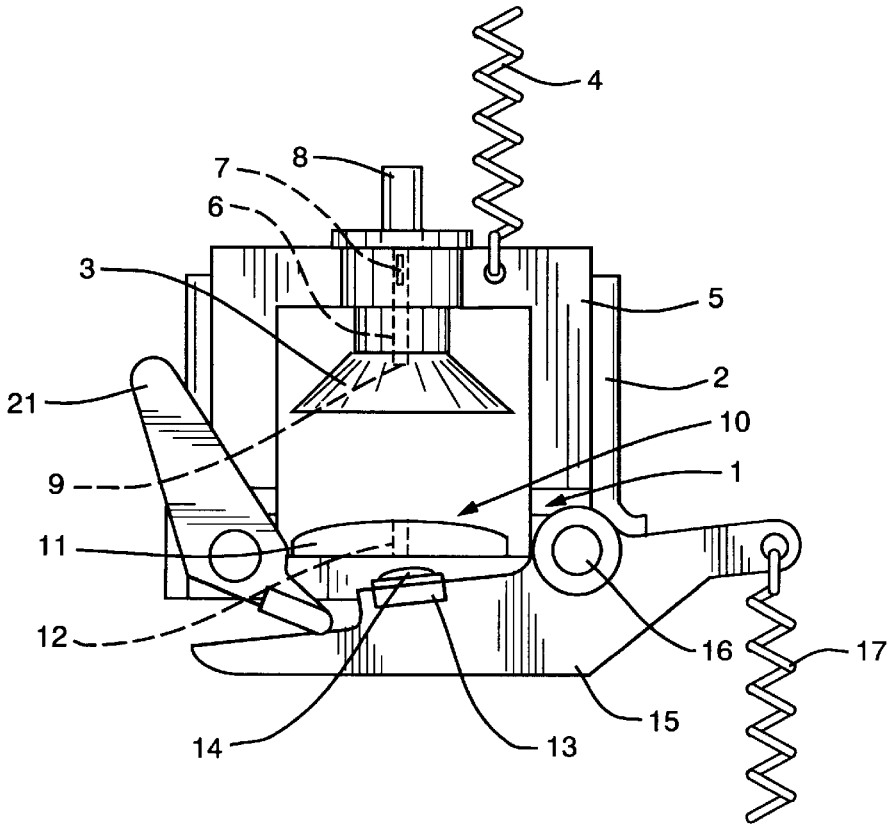
FIG. 2 is a diagrammatic side view of an opened time switch.

The time switch has a housing or a support frame 1 on which there is provided a plate or the like as a counterpart body 11 in relation to a suction cup 3 which is arranged on a switching member 5. The switching member 5 is mounted displaceably in a guide 2 and has a bore 6 which terminates in an air inlet opening 9 of small cross-section, which is arranged within the suction cup 3. The cross-section of the air inlet opening 9 is adjustable to control the release time of the suction cup 3 from the counterpart body 11. The outer end of the bore 6 preferably carries a needle valve 7 with an adjusting screw 8, the rotation of which changes the speed at which the air flows into the reduced-pressure space 10. A return spring 4 urges the switching member 5 in opposite relationship to the suction force of the suction cup 3 so that the switching member 5 is transferred from the position shown in FIG. 1 after sufficient intake of air by way of the opening 9 into the position shown in FIG. 2.

If the switching time is to be shortened once, this is not effected by turning the adjusting screw 8 which would then have to be re-set, but by venting the reduced-pressure space 10. For that purpose the counterpart body 11 is provided which venting opening 12 associated with the reduced-pressure space 10 comprising a sealing closure element 13 which is urged in the closed position.

The closure element 13 is provided with a seal 14 and arranged on a lever 15 which is pivotable about an axis 16. The lever 15 is engaged on the one hand by a return spring 17 which presses the closure element 13 against the venting opening 12 and on the other an actuating element 21, by means of which the venting opening 12 can be opened and which acts in opposite relationship to the return spring 17.

What is claimed is:

1. A time switch comprising:

a switching member on which a suction cup is arranged, a counterpart body against which the suction cup is pressed forming a reduced-pressure space, with air contained in the suction cup being displaced, an air inlet opening into the reduced-pressure space, wherein said opening has a cross-section to establish the release time of the suction cup from the counterpart body, a resetting device whose resetting force is less than the suction force of the suction cup when pressed against the counterpart body, and a venting opening associated with the reduced-pressure space comprising a sealing closure element which is urged in the closed position.

2. The time switch according to claim 1 wherein the counterpart body is a fixed plate and the venting opening which is provided with the closure element is disposed in the counterpart body.

3. The time switch according to claim 2 wherein the closure element is arranged on a lever wherein said lever is engaged by a return spring and an actuating element wherein the actuating element operates against the return spring.

4. The time switch according to claim 1 wherein the cross-section of the air inlet opening is adjustable to control the release time of the suction cup from the counterpart body.

* * * * *